US006352066B1

(12) United States Patent
Guentert et al.

(10) Patent No.: US 6,352,066 B1
(45) Date of Patent: Mar. 5, 2002

(54) COMMON RAIL SYSTEM FOR INTERNAL COMBUSTION ENGINES

(75) Inventors: Josef Guentert, Gerlingen; Uwe Kuhn, Riederich; Juergen Hammer, Fellbach, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/465,840

(22) Filed: Dec. 17, 1999

(30) Foreign Application Priority Data

Dec. 19, 1998 (DE) ..... 198 58 861

(51) Int. Cl.[7] ..... F01P 1/06
(52) U.S. Cl. ..... 123/509; 123/41.31
(58) Field of Search ..... 123/509, 456, 123/41.31, 506; 417/360

(56) References Cited

U.S. PATENT DOCUMENTS 4,517,946 A * 5/1985 Takano et al. ..... 123/450
4,870,940 A * 10/1989 Filippi et al. ..... 123/506
5,007,806 A * 4/1991 Bellis et al. ..... 417/360
5,419,298 A * 5/1995 Nolte et al. ..... 123/508
5,603,304 A * 2/1997 Matczak ..... 123/509
5,626,121 A 5/1997 Kushida et al. ..... 123/514
5,788,381 A * 8/1998 Yamazaki et al. ..... 384/400

FOREIGN PATENT DOCUMENTS

| | | | |
|---|---|---|---|
| DE | 19716242 | A1 | 10/1998 |
| DE | 19736160 | A1 | 2/1999 |
| JP | 0090060562 | AA | 8/1995 |
| JP | 0090088761 | AA | 9/1995 |

* cited by examiner

*Primary Examiner*—Henry C. Yuen
*Assistant Examiner*—Mahmoud Gimie
(74) *Attorney, Agent, or Firm*—Ronald E. Greigg

(57) ABSTRACT

A common rail system for internal combustion engines, having a high-pressure pump mounted on a part of the engine, especially on an engine block, control gear or reduction gear. For thermal decoupling purposes, the contact areas between the part of the engine and the high-pressure pump are minimized.

16 Claims, 4 Drawing Sheets

COMMON RAIL SYSTEM FOR INTERNAL COMBUSTION ENGINES

BACKGROUND OF THE INVENTION

The invention relates to a common rail system for internal combustion engines, having a high-pressure pump mounted on a part of the engine, especially on an engine block, control gear or reduction gear.

Mounting the high-pressure pump on the face end on the engine block below the cylinder head offers the advantage that shear forces from the drive mechanism are absorbed by the stable engine block. This also makes for a compact structure. Furthermore, the entire engine block can be used for both Diesel and Otto engines. No additional mounting brackets are needed. As needed, the lubrication of the drive can be integrated with the engine oil loop.

However, mounting the high-pressure pump on a part of the engine also involves problems. In the context of the present invention, it has been discovered that the temperature problem that exists anyway in common rail systems, resulting from the diversion in leakage of high-pressure Diesel fuel, is made even worse by mounting on the engine. Both measurements and simulation calculations have shown that the high-pressure pump becomes heated directly by the engine block and when mounted stationary virtually assumes the same temperature. In addition, heating of the high-pressure pump occurs from the lubrication of the drive mechanism with the hot motor oil. On the other hand, the fuel flow, used for cooling and lubrication, through the crank chamber of the high-pressure pump causes a major convective dissipation of heat from the engine. The heat flow taken from the engine is stored in the fuel and definitively contributes to heating of the fuel, which is undesirable especially in the tank. An expensive fuel cooler is therefore often needed in the low-pressure feed loop.

OBJECT AND SUMMARY OF THE INVENTION

It is an object of the invention to furnish suitable structural provisions for thermally decoupling the high-pressure pump from the engine. No change is intended in the mounting position on the engine block, control gear or reduction gear.

In a common rail system for internal combustion engines, having a high-pressure pump mounted on a part of the engine, especially on an engine block, control gear or reduction gear, is attained in that the contact areas between the part of the engine and the high-pressure pump are minimized. This offers the advantage that the fuel cooler required can be made smaller, or in combination with a quantity-controlled high-pressure pump can possibly be dispensed with entirely. Both options offer a cost advantage over earlier concepts and thus have a competitive advantage.

A particular embodiment of the invention is characterized in that the number and area of air gaps between the high-pressure pump and/or the part of the engine is maximized. As a result, the quantity of heat transmitted by the engine to the high-pressure pump and thus into the fuel loop is reduced.

Another particular embodiment of the invention is characterized in that the mounting face on the part of the engine or on the high-pressure pump has a centering rib. The centering is required to enable a transmission of force to the drive shaft of the high-pressure pump. Achieving the centering by means of the centering rib has the advantage that the contact area absolutely required for the centering is minimized.

A further special embodiment of the invention is characterized in that the mounting face on the high-pressure pump is shielded by a cover plate. Such a cover plate is especially advantageous whenever the mounting area is relatively large and comes into contact with hot motor oil. By means of the cover plate, the heat transfer by convection is sharply restricted.

Another special embodiment of the invention is characterized in that the cover plate rests on an annular bearing face of the high-pressure pump. The annular bearing face offers stable support for the cover plate. At the same time, however, because of the annular embodiment of the bearing face, it is assured that the contact area between the cover plate and the high-pressure pump is minimized.

Another special embodiment of the invention is characterized in that a void is formed between the part of the engine or of the gear and the high-pressure pump. The void, which as a rule is filled with air, assures very good thermal insulation between the part of the engine and the high-pressure pump. This reduces the quantity of heat transmitted from the motor to the high-pressure pump still further.

Another special feature of the invention is characterized in that an insulating layer is introduced on the contact faces between the part of the engine and the high-pressure pump. The insulating layer comprises a material of low thermal conductivity. The insulating layer can already be applied in the process of production of the engine or high-pressure pump.

Further advantages, characteristics and details of the invention will become apparent from the ensuing description, in which various exemplary embodiments of the invention are described in detail in conjunction with the drawings. Characteristics recited in the claims and in the description can each be essential to the invention individually or in any arbitrary combination.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
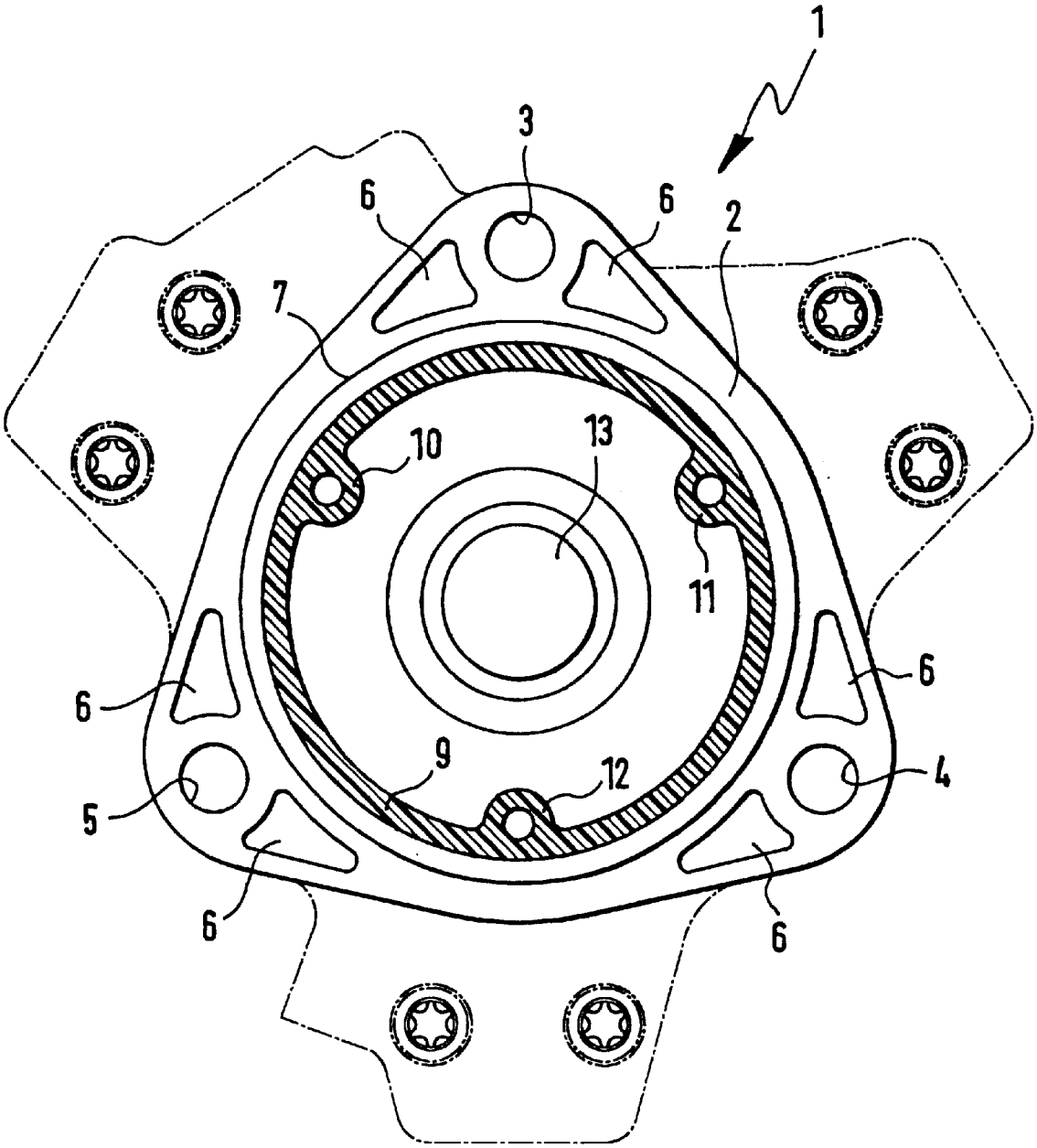
FIG. 1 is a plan view on a flange of a high-pressure pump according to a first embodiment of the invention.

The high-pressure pump designated overall by reference numeral 1 in FIG. 1 is used in particular in common rail injection systems for supplying fuel to Diesel engines. The term "common rail" means the same as "common line". In contrast to conventional high-pressure injection systems, in which the fuel is fed to the individual combustion chambers via separate lines, in the common rail injection system the injection nozzles are supplied from a common line.

The high-pressure pump 1 shown in FIG. 1 has a flange 2, which serves to secure the high-pressure pump 1 to a part of an internal combustion engine. Bores 3, 4 and 5 are provided in the flange 2 and serve to receive fastening screws (not shown). Recesses 6 are made in the flange 2 in the region of the bores 3, 4 and 5. The recesses 6 have the purpose of reducing the contact area between the high-pressure pump 1 and the part of the engine to which the high-pressure pump 1 is secured. A centering rib 7 is embodied in the interior of the flange 2. In the installed state of the high-pressure pump 1, the centering rib 7 assures exact centering. The centering of the high-pressure pump 1 is required to assure that the drive is free of malfunctions.

An annular bearing face 9 is embodied concentrically inside the flange 2. The annular bearing face 9 is located in a plane that is offset toward the high-pressure pump 1 relative to the surface of the flange 2. Accordingly the annular bearing face 9 does not contact the part of the engine on which the high-pressure pump 1 is mounted. Eyelets 10, 11 and 12 are formed onto the annular bearing face 9. The eyelets 10, 11 and 12 are used for securing a cover plate (not shown in FIG. 1). The function of the cover plate will be described in further detail hereinafter.

The drive shaft 13 of the high-pressure pump 1 is disposed concentrically to the flange 2 and to the annular bearing face 9. The drive shaft 13 can for instance be coupled with the control gear of the engine. Alternatively, a reduction gear can be connected between the control gear and the drive shaft 13 and furnishes a desired rpm to the drive shaft 13.

Figure 2:
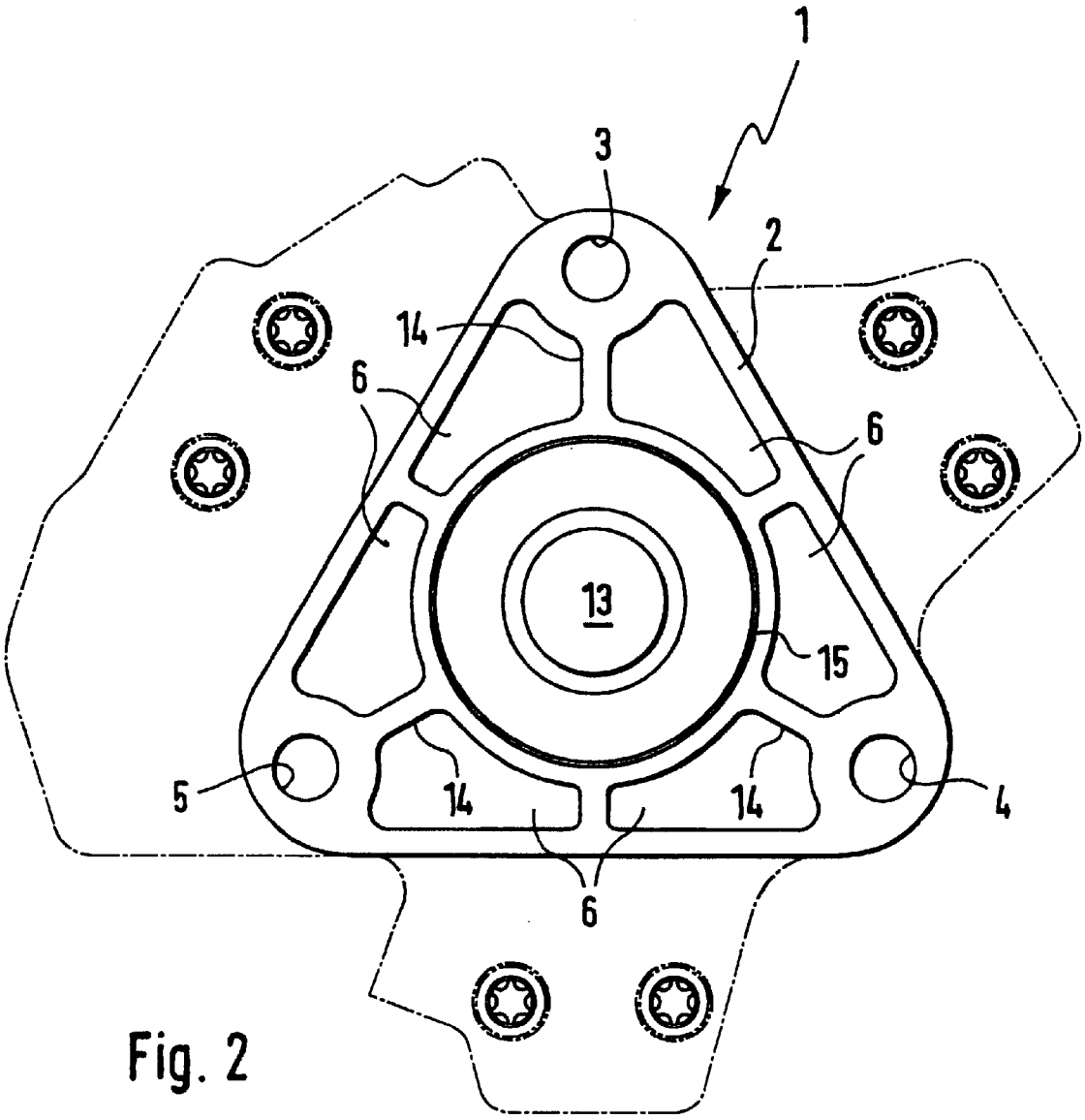
FIG. 2 is a plan view on a flange of a high-pressure pump according to a second embodiment of the invention.

The high-pressure pump 1 shown in FIG. 2 is similar to the high-pressure pump shown in FIG. 1. For the sake of simplicity, the same reference numerals will be used for the same elements. The high-pressure pump 1 shown in FIG. 2 has a flange 2 with a triangular outer contour. Three bores 3, 4 and 5 are recessed in the flange 2 and serve to receive fastening screws. Via ribs 14, the flange 2 is joined to a centering rib 15. Between the flange 2 and the centering rib 15, a plurality of recesses 6 are formed, divided by the ribs 14. The recesses 6 serve to minimize the contact area between the high-pressure pump 1 and the part of the engine on which the high-pressure pump 1 is mounted. As in the embodiment shown in FIG. 1, the drive shaft 13 of the high-pressure pump 1 is disposed concentrically to the centering rib 15.

Figure 3:
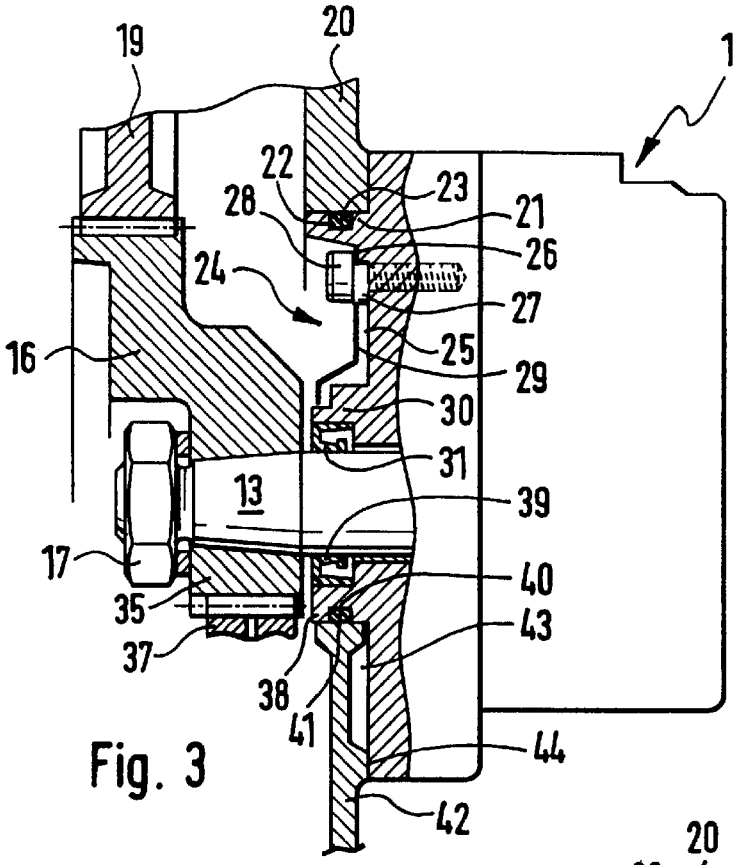
FIG. 3 is a section taken longitudinally of the drive shaft of a common rail system in accordance with two further embodiments of the invention.

In FIG. 3, two different embodiments of the invention are shown. The drive shaft of a high-pressure pump 1 is identified by reference numeral 13. One embodiment of the invention is shown above the longitudinal axis of the drive shaft 13, and the other is shown below the longitudinal axis of the drive shaft 13. The embodiment shown in the upper half will be described first.

The drive shaft 13 has a conical end, on which a gear wheel 16 is secured with the aid of a nut 17. The gear wheel 16 meshes with another gear wheel 19, which is part of the control gear of an engine. The control gear is accommodated in a housing 20. The high-pressure pump 1 is flanged to the housing 20 of the control gear. The centering of the high-pressure pump 1 is effected by a centering rib 21, which is embodied on the high-pressure pump 1. An encompassing annular groove 22, which serves to receive an O-ring 23, is recessed into the centering rib 21.

Since the centering rib 21 is disposed in the outer circumferential region of the high-pressure pump 1, the mounting face, marked 24, of the high-pressure pump is relatively large. As a consequence, hot motor oil located in the interior of the housing 20 comes into contact with a relatively large area of the high-pressure pump 1. To reduce the convective heat transfer, a recess 25 on the mounting face 24 of the high-pressure pump 1 is covered by a cover plate 29. To that end, an annular bearing face 26 for supporting the cover plate 29 is formed below the centering rib 21. A screw 28 used for securing the cover plate 29 is received in an eyelet 27. In the region of the drive shaft 13, the high-pressure pump 1 is equipped with an encompassing protrusion 30, which fixes a shaft seal 31.

The embodiment shown in the lower half of FIG. 3 differs from that shown in the upper half essentially in that the circumference of a gear wheel 35, which is secured to the shaft 13, is considerably less than the circumference of the gear wheel 16. The gear wheel 35 is an engagement with a gear wheel 37, which is part of a reduction gear. The reduction gear serves to vary the rpm furnished by the control gear of the engine.

A centering rib 38 is embodied on the high-pressure pump 1. The centering rib 38 is disposed in the vicinity of the drive shaft 13 and has a shoulder, on the side oriented toward the drive shaft 13, for fixing a shaft seal 39. On the other side, an encompassing groove 40 is recessed into the centering rib 38. The groove 30 is used to receive an O-ring 41, which rests on a part of the housing 42 of the reduction gear. A void 43 is formed in the housing 42, on the side toward the high-pressure pump 1. The void 43 is defined by an annular bearing face 44 that contacts the high-pressure pump 1. The void 43 serves the purpose of insulation.

Figure 4:
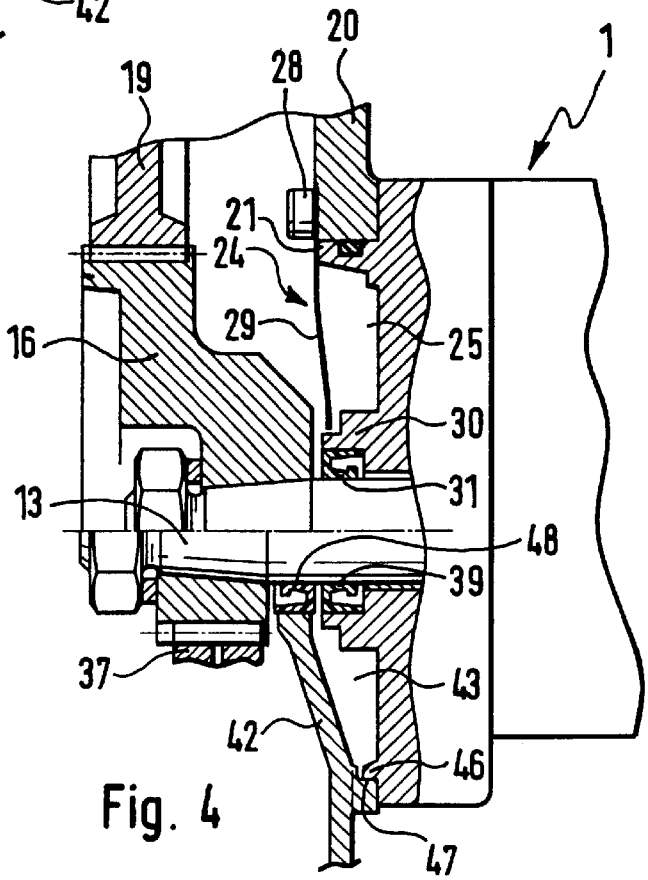
FIG. 4 is a similar section to FIG. 3, for two further embodiments of the invention.

The embodiment shown in the upper half of FIG. 4 is similar to the embodiment shown in the upper half of FIG. 3. To avoid repetition, the entire description will not be repeated; instead, the differences between the two embodiments will be described. In the embodiment shown in FIG. 4, the cover plate 29 is mounted not on the high-pressure pump 1 but rather on the housing 20 of a part of the engine. The fastening of the cover plate 29 is done by means of a screw 28. It is theoretically conceivable for the screw 28 to serve the purpose not only of securing the cover plate 29 but also of securing the high-pressure pump 1 to the housing 20. However, that way of fastening the high-pressure pump 1 is relatively complicated, since the screw 28 is accessible only from the inside of the housing 20.

The embodiment shown in the lower half of FIG. 4 differs from that shown in the upper half of FIG. 3 in that the centering of the high-pressure pump 1 is done not in the region of the drive shaft 13 but rather along the outer circumference of the high-pressure pump 1. A centering rib 46 is embodied on the outer circumference of the high-pressure pump 1. The centering rib 46 contacts a corresponding encompassing edge 47 of the housing 42. The housing 42 extends as far as the drive shaft 13 and has a separate shaft seal 48.

A relatively large void 43 is formed between the housing 42 and the high-pressure pump 1. Separately sealing off the housing 42 and the high-pressure pump 1 from the drive shaft 13 of the high-pressure pump 1 has the advantage of achieving a secure separation of the motor oil present in the housing 42 from the fuel contained in the high-pressure pump 1.

Figure 5:
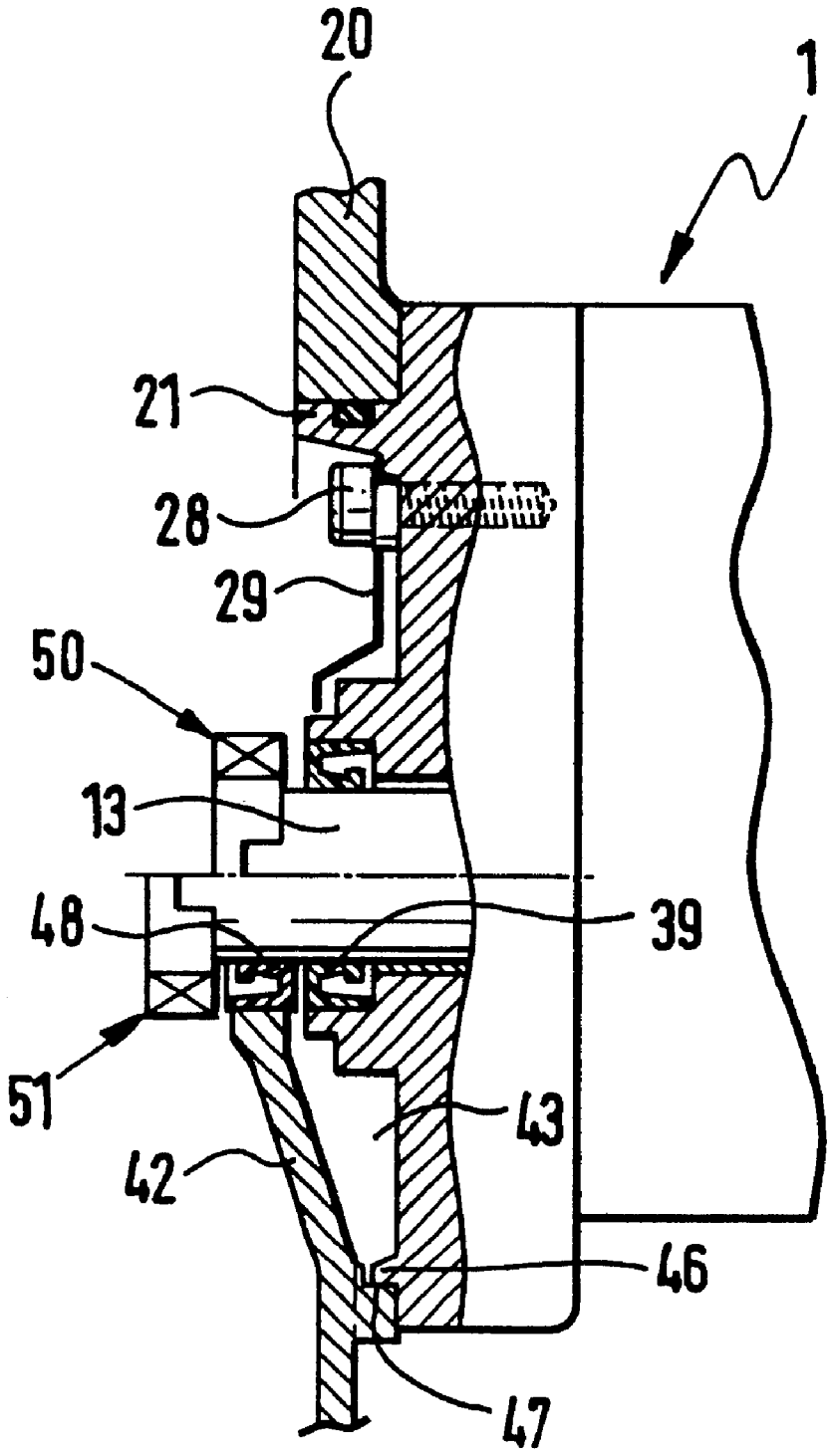
FIG. 5 is a section as in FIGS. 3 and 4, for two further embodiments of the invention.

In the upper half of FIG. 5, an embodiment of the invention is shown that corresponds to the embodiment of the invention shown in the upper half of FIG. 3. In the lower half of FIG. 5, an embodiment of the invention is shown that corresponds to the embodiment of the invention shown in the lower half of FIG. 4. Unlike the embodiments described above, in both of the embodiments described in FIG. 5 the drive shaft 13 is coupled with a coupling 50, 51. As the coupling, a yoke coupling can for instance be used.

The foregoing relates to preferred exemplary embodiments of the invention, it being understood that other variants and embodiments thereof are possible within the spirit and scope of the invention, the latter being defined by the appended claims.

We claim:

1. A common rail system for internal combustion engines, comprising, a high-pressure pump (1) mounted on a part of an engine block via a flange (2), a control gear or reduction gear in said part of said engine to which said high pressure pump is mounted, and contact areas between the part (20, 42) of the engine and the high-pressure pump (1) are minimized by a plurality of recesses (6) in said flange (2).

2. The common rail system according to claim 1, in which a number of air gapareas (43) are formed between the high-pressure pump (1) and/or the part (42) of the engine in which the air gap areas are maximized.

3. The common rail system according to claim 1, in which a mounting face (24) on the part of the engine or on the high-pressure pump (1) has a centering rib (7, 15, 21, 38, 46) for centering said high-pressure pump.

4. The common rail system according to claim 2, in which a mounting face (24) on the part of the engine or on the high-pressure pump (1) has a centering rib (7, 15, 21, 38, 46) for centering said high-pressure pump.

5. The common rail system according to claim 3, in which the mounting face on the high-pressure pump is shielded from heat by a cover plate (29).

6. The common rail system according to claim 4, in which the mounting face on the high-pressure pump is shielded from heat by a cover plate (29).

7. The common rail system according to claim 5, in which the cover plate (29) rests on an annular bearing face (26) of the high-pressure pump.

8. The common rail system according to claim 1, in which a void (43) is formed between a part of the engine or of the housing (42) and the high-pressure pump (1).

9. The common rail system according to claim 2, in which a void (43) is formed between a part of the engine or of the housing (42) and the high-pressure pump (1).

10. The common rail system according to claim 3, in which a void (43) is formed between a part of the engine or of the housing (42) and the high-pressure pump (1).

11. The common rail system according to claim 1, in which an insulating layer is introduced on the contact faces between the part of the engine and the high-pressure pump.

12. The common rail system according to claim 2, in which an insulating layer is introduced on the contact faces between the part of the engine and the high-pressure pump.

13. The common rail system according to claim 3, in which an insulating layer is introduced on the contact faces between the part of the engine and the high-pressure pump.

14. The common rail system according to claim 5, in which an insulating layer is introduced on the contact faces between the part of the engine and the high-pressure pump.

15. The common rail system according to claim 7, in which an insulating layer is introduced on the contact faces between the part of the engine and the high-pressure pump.

16. The common rail system according to claim 8, in which an insulating layer is introduced on the contact faces between the part of the engine and the high-pressure pump.

* * * * *